US006108188A

United States Patent [19]

Denison et al.

[11] Patent Number: 6,108,188

[45] Date of Patent: Aug. 22, 2000

[54] ELECTRONIC LOCKING SYSTEM WITH AN ACCESS-CONTROL SOLENOID

[75] Inventors: William D. Denison, Palos Hills; Lawrence C. Brownfield, Downers Grove; Bradley S. Silvers, Oswego, all of Ill.

[73] Assignee: Micro Enhanced Technology, Countryside, Ill.

[21] Appl. No.: 09/232,032

[22] Filed: Jan. 15, 1999

[51] Int. Cl.[7] ..... H01H 9/00

[52] U.S. Cl. ..... 361/160; 361/170; 361/171

[58] Field of Search ..... 361/160, 170, 361/171, 182, 194

[56] References Cited

U.S. PATENT DOCUMENTS 3,733,861 5/1973 Lester ..... 70/153

5,617,082 4/1997 Denison et al. .

*Primary Examiner*—Stephen W. Jackson

*Attorney, Agent, or Firm*—Leydig, Voit & Mayer

[57] ABSTRACT

An electronic locking system with an access-control solenoid for controlling the operation of a locking mechanism is substantially immune to "hot-wiring." The locking system includes an actuating circuit for energizing the access-control solenoid. The actuating circuit is responsive to a modulated drive signal of a selected frequency to apply current through the solenoid to retract its plunger, while blocking externally applied DC voltages from reaching the solenoid. When an access code is entered through an input device, a control circuit of the locking system verifies the access code. When the code is verified, the control circuit generates the modulated drive signal to energize the solenoid to retract the plunger, thereby allowing the locking mechanism to be unlocked. After the plunger is retracted, the frequency of the modulated drive signal is changed to reduce the power consumption for retaining the plunger in its retracted position.

16 Claims, 8 Drawing Sheets

ELECTRONIC LOCKING SYSTEM WITH AN ACCESS-CONTROL SOLENOID

TECHNICAL FIELD OF THE INVENTION

The present invention relates generally to electronic locking systems, and more particularly to an electronic locking system having an access-control solenoid and a method of operating such solenoid in the electronic locking system.

BACKGROUND OF THE INVENTION

Electronic locking systems have been widely used for controlling access to secured enclosures such as security and fire safes. Such locking systems typically have an electronic control module with an input device, such as a keypad, for entering an access code, and an access-control solenoid for controlling the operation of a locking mechanism. When the access code is determined to be valid, the solenoid is energized to retract its plunger, thereby permitting the locking mechanism to be unlocked. Due to considerations such as integrity of the enclosure, cost of construction, ease of installment, space constraints, etc., the electronic control module of the electronic locking system is typically mounted on the exterior of the secured enclosure, with wires leading to the access-control solenoid mounted inside the secured enclosure. U.S. Pat. No. 5,617,082, entitled "Electronic Access Control Device Utilizing a Single Microcomputer Integrated Circuit," describes a useful, cost effective and easily manufactured electronic locking system designed for such placement.

A general problem associated with placing the electronics of a locking system on the exterior of a secured enclosure is the vulnerability to tampering. In the case of a locking mechanism controlled by a solenoid, the electronic locking system may be defeated by "hot-wiring," in which case a tamperer severs the wires leading to the solenoid and applies a DC voltage to the wires, thereby energizing the solenoid to retract its plunger.

SUMMARY OF THE INVENTION

In view of the foregoing, it is a general object of the present invention to make an electronic locking system with an access-control solenoid more tamper-proof while allowing flexible placement of the lock electronics.

It is a related and more specific object of the invention to minimize the vulnerability of an electronic locking system with an access-control solenoid to "hot-wiring," without significantly increasing the complexity of the system or requiring significant and costly alteration of the system or the placement thereof.

It is another related object of the invention to provide an electronic locking system with an access-control solenoid as in the foregoing object that is energy-efficient in operation.

In accordance with these and other objects of the invention, there is provided an electronic locking system with an access-control solenoid that uses a modulated drive signal to control the energizing of the access-control solenoid. The electronic locking system includes a control circuit that generates a modulated drive signal, and an actuating circuit that applies an energizing current through the access-control solenoid in response to the modulated drive signal to energize the solenoid. The actuating circuit blocks any DC voltage from reaching the solenoid, thereby making the locking system immune to "hot-wiring" by a tamperer.

Additional features, advantages, and objects of the invention will be made apparent from the following detailed description of illustrative embodiments which proceeds with reference to the accompanying figures.

BRIEF DESCRIPTION OF THE DRAWINGS

While the appended claims set forth the features of the present invention with particularity, the invention may be best understood from the following detailed description taken in conjunction with the accompanying drawings of which:

DETAILED DESCRIPTION OF THE INVENTION

Figure 1:
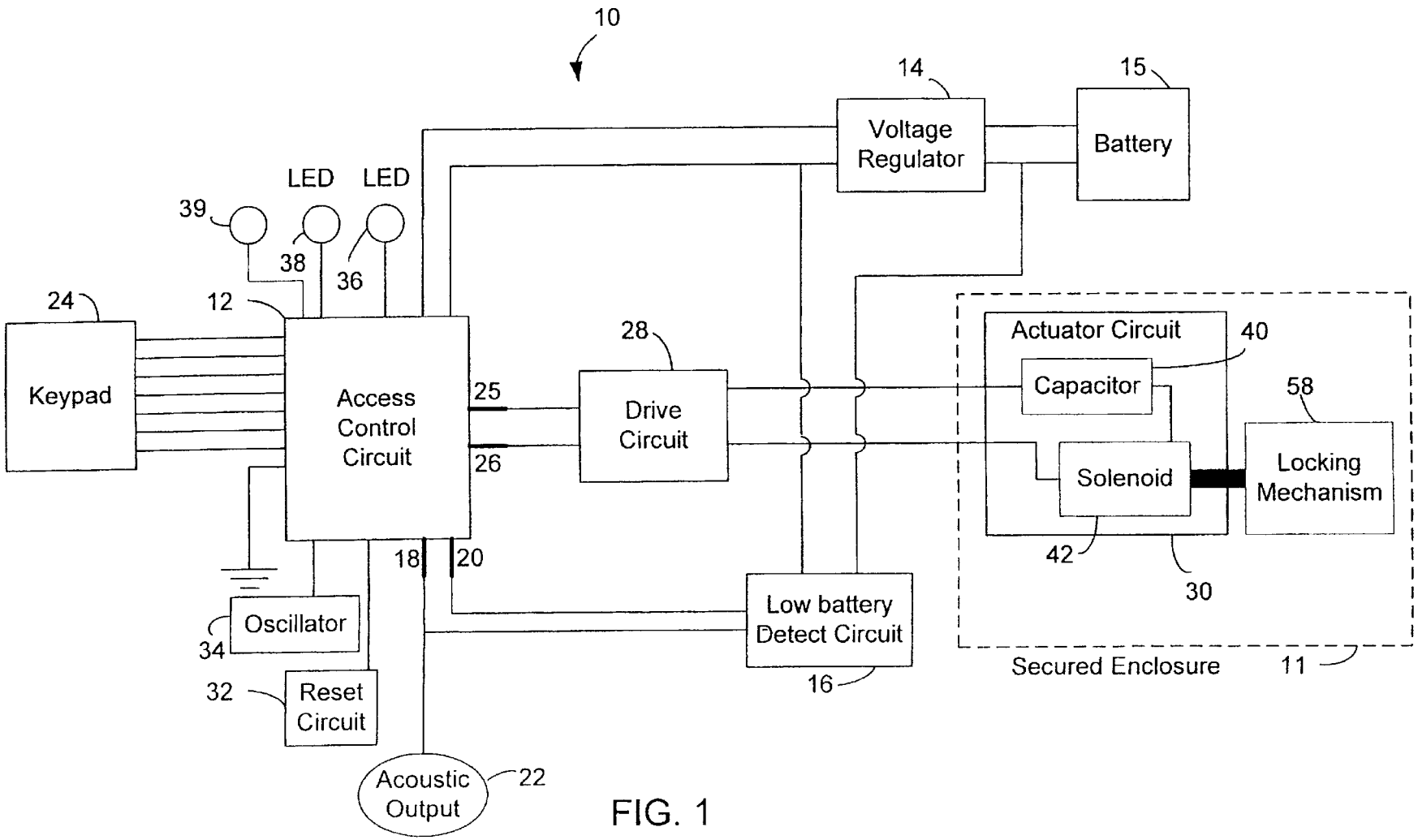
FIG. 1 is a schematic diagram of an electronic locking system incorporating an embodiment of the invention.

Turning to the drawings, FIG. 1 shows the overall layout of an embodiment of an electronic locking system 10 incorporating the present invention for controlling access to a secured enclosure 11. The secured enclosure 11 is protected by a locking mechanism 58, the operation of which is controlled by an access-control solenoid 42. When the access-control solenoid 42 is properly energized to retract its plunger, the locking mechanism may be operated to allow access to the secured enclosure 11. The energizing of the solenoid 42 is by means of an actuating circuit 30 controlled by an access control circuit 12. In accordance with an aspect of the invention, the access control circuit 12 may be placed external to the secured enclosure, while the locking mechanism and the access-control solenoid are placed inside the secured enclosure. As will be described in greater detail below, the actuating circuit 28 for energizing the solenoid is preferably also enclosed in the secured enclosure so that it is protected from tampering.

In a preferred embodiment of the invention, the access control circuit 12 includes a microprocessor having the architecture and executing the steps described in U.S. Pat. No. 5,617,082, which is incorporated herein by reference. The system includes an input device for user interface, which is preferably a keypad 24 for entering an access code. An LED 36 is used to indicate an error condition, such as the entering of a wrong access code. Another LED 38 is used to signal that the electronic locking system is in proper operation so that the user can proceed. The operation of the keypad 24, a reset circuit 32, an oscillator 34, and the LEDs 36 and 38 are also described in the referenced patent.

To access the secured enclosure 11 protected by the locking system, a user enters a combination access code using the keypad 24. When the access control circuit 12 receives the entered access code, it verifies the access code to determine whether access to the secured enclosure should be allowed. In a preferred embodiment, the verification of the access code involves a comparison of an internal code stored in the access control circuit 12. The internal code may be a pre-stored fixed code, or a code that changes with time in ways known to those skilled in the art. If the entered access code matches the internal code, the access control circuit 12 sends a control signal to a drive circuit 28, which in response generates a modulated drive signal to activate the actuating circuit 30 to energize the solenoid 42 in accordance with the invention as described in greater detail below.

The electronic locking system shown in FIG. 1 is powered by a battery 15. In one embodiment of the locking system, the battery 15 includes one or more dry-cell batteries, such as alkaline batteries, to provide a nominal DC output voltage of about 6V DC. This voltage supply is available to the drive circuit 28 for energizing the solenoid. The output voltage of the battery is also regulated by a voltage regulator 14, which provides a 3.3V DC supply for the microprocessor circuit. The output of the voltage regulator 14 also serves as a voltage reference for a low-battery detection circuit 16. As the locking system is in operation over a period of time, the battery power will be consumed and the battery voltage will gradually decrease, such as from the nominal 6V when the battery 15 is new to a 5V output when the battery power has been significantly drained. As the locking system is operated, the control circuit 12 operates the low-battery detection circuit 16 to compare the 3.3V reference signal with a fraction of the battery voltage provided by an internal resistor divider circuit. If a low battery voltage is detected, the control circuit signals the low-battery condition by energizing a "low-battery" LED 39 for a pre-selected period of time, such as 3 seconds, during the operation of the locking system.

Figure 2:
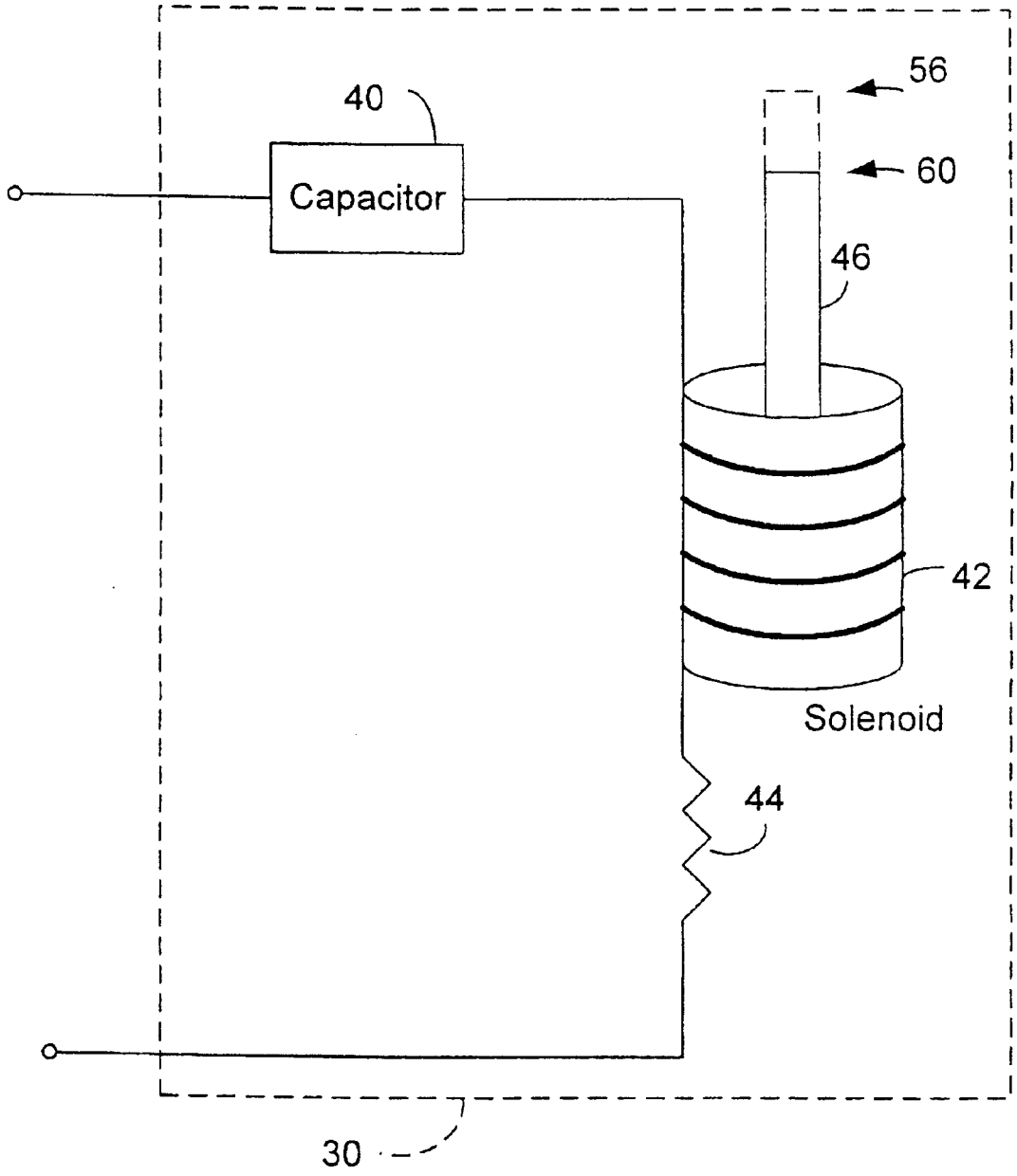
FIG. 2 is a schematic diagram of an embodiment of an actuating circuit for energizing an access-control solenoid according to the invention.

The access-control solenoid 42, as shown in FIG. 2, includes a plunger 46 that is movable between an extended or locked position 56 (shown in broken lines) and an retracted or unlocked position 60. The plunger 46 is used to mechanically control the operation of the locking mechanism 58 (FIG. 1) such that moving the plunger into its retracted position enables the locking mechanism to be unlocked to gain access to the secured enclosure. It will be appreciated by those skilled in the art that the exact construction of the locking mechanism and how the plunger interacts with the locking mechanism are not critical to the invention. For example, the locking mechanism may be in the simple form of a door latch, or may have a much more complex structure. The plunger may play an active role such that its movement is used to actively actuate and unlock the locking mechanism. Alternatively, the plunger in its extended position may simply be used to block the movement of components of the locking mechanism to retain it in a locked condition. When the plunger 46 is retracted, the locking mechanism may be operated, for example, by manually turning a door handle.

In a preferred embodiment, the plunger 46 is biased by a spring of a known type toward the extended position 56. When the solenoid 42 is properly energized, the magnetic field generated therein pulls the plunger 46 against the bias spring into the retracted position 60. The plunger is preferably retained in the retracted position for a pre-selected period of time, such as 5 seconds, to allow the user to operate the locking mechanism to gain access to the secured enclosure. After the pre-selected time period has expired, the solenoid is de-energized, and the plunger is returned to the extended position by the bias spring.

In accordance with a feature of the invention, the energizing of the access-control solenoid is activated by a modulated, non-DC, drive signal, and the actuating circuit in response to the modulated drive signal applies an energizing current through the solenoid, causing the retraction of the plunger. The actuating circuit blocks a DC voltage from reaching the solenoid 42. As a result, the solenoid 42 cannot be energized to open the lock by simply applying a DC voltage to the wires leading to the actuating circuit 30. In other words, the electronic locking system is substantially immune to "hot-wiring." The term "modulated signal" is used herein broadly to include AC current or voltage signals (with alternating polarities) and voltage-modulated signals.

In one embodiment as shown in FIG. 2, the actuating circuit 30 includes a capacitor 40 connected in series with the solenoid 42. The capacitor 40, working as a high-pass filter, prevents a DC voltage applied to the input wires of the actuating circuit from reaching the solenoid, thereby removing the possibility for a tamperer to hot-wire the circuit to open the lock. Due to the use of the capacitor 40 to block DC voltages, the actuating circuit cannot be driven with a DC voltage, which is the conventional way an access-control solenoid in a conventional locking system is energized.

In accordance with a related feature of the embodiment, a modulated drive signal with an operating frequency set according to the electrical characteristics of the solenoid 42 and the capacitor 40 is used to operate the actuating circuit 30 to energize the solenoid 42 to retract the plunger. More particularly, as shown in FIG. 2, the solenoid 42 and the capacitor 40 form an RLC circuit, where the resistance includes the inherent series resistance solenoid. This RLC circuit has a resonance frequency at which the imaginary inductive impedance of the solenoid cancels the imaginary impedance of the capacitor. This resonance frequency is determined as $f_{res}=\frac{1}{2}\pi(LC)^{1/2}$, where $f_{res}$ is the resonance frequency, L is the inductance of the solenoid 42, and C is the capacitance of the capacitor 40.

Figure 3:
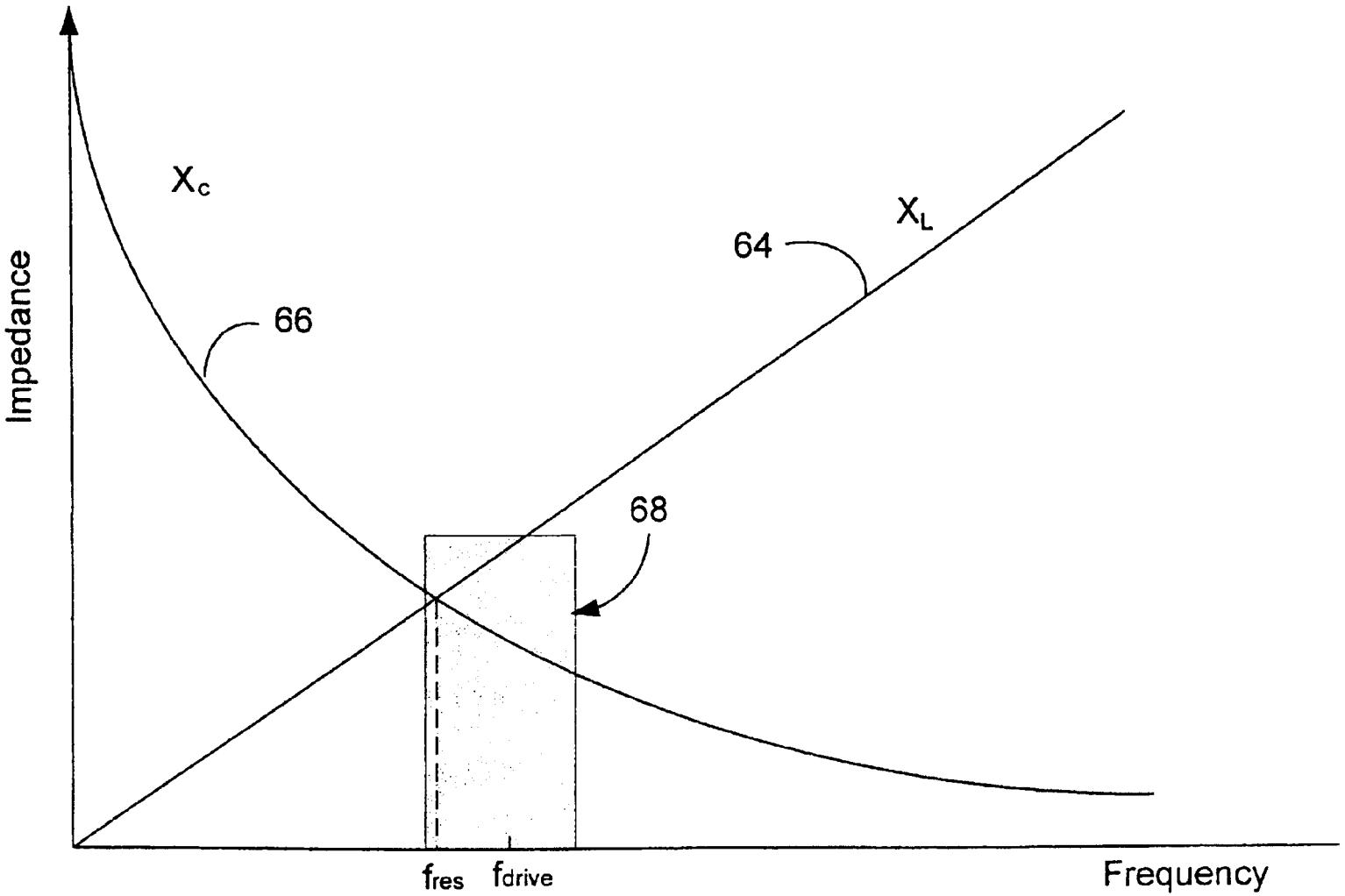
FIG. 3 is a chart illustrating impedance variations of components of the actuating circuit of FIG. 2.

To effectively energize the solenoid, the operating frequency of the AC drive signal is set to be adjacent the resonance frequency. FIG. 3 shows the magnitudes of the inductive impedance (designated 64) and the capacitive impedance (designated 66) as functions of frequency. As illustrated in the graph of FIG. 3, the capacitive impedance and inductive impedance are equal in magnitude at the resonance frequency $f_{res}$ and therefore cancel each other out since they are of opposite signs. When an AC drive signal with a frequency $f_{drive}$ adjacent the resonance frequency $f_{res}$ is applied to the solenoid 42 through the capacitor 40, a DC component of the current flowing through the solenoid 42 is developed, and the magnetic field generated by the current moves the plunger 46 into the unlocked position 60 and keeps it in that position, allowing the locking mechanism to be operated to access the secured enclosure.

The frequency range 68 in which an AC drive signal is effective to achieve the retraction of the plunger depends on the characteristics of the components in the specific implementation of the system. With a given solenoid and capacitor combination, the effective drive signal frequency range can be easily identified experimentally. Generally, the operable frequency range goes from about the resonant frequency to slightly above the resonant frequency.

Figure 4:
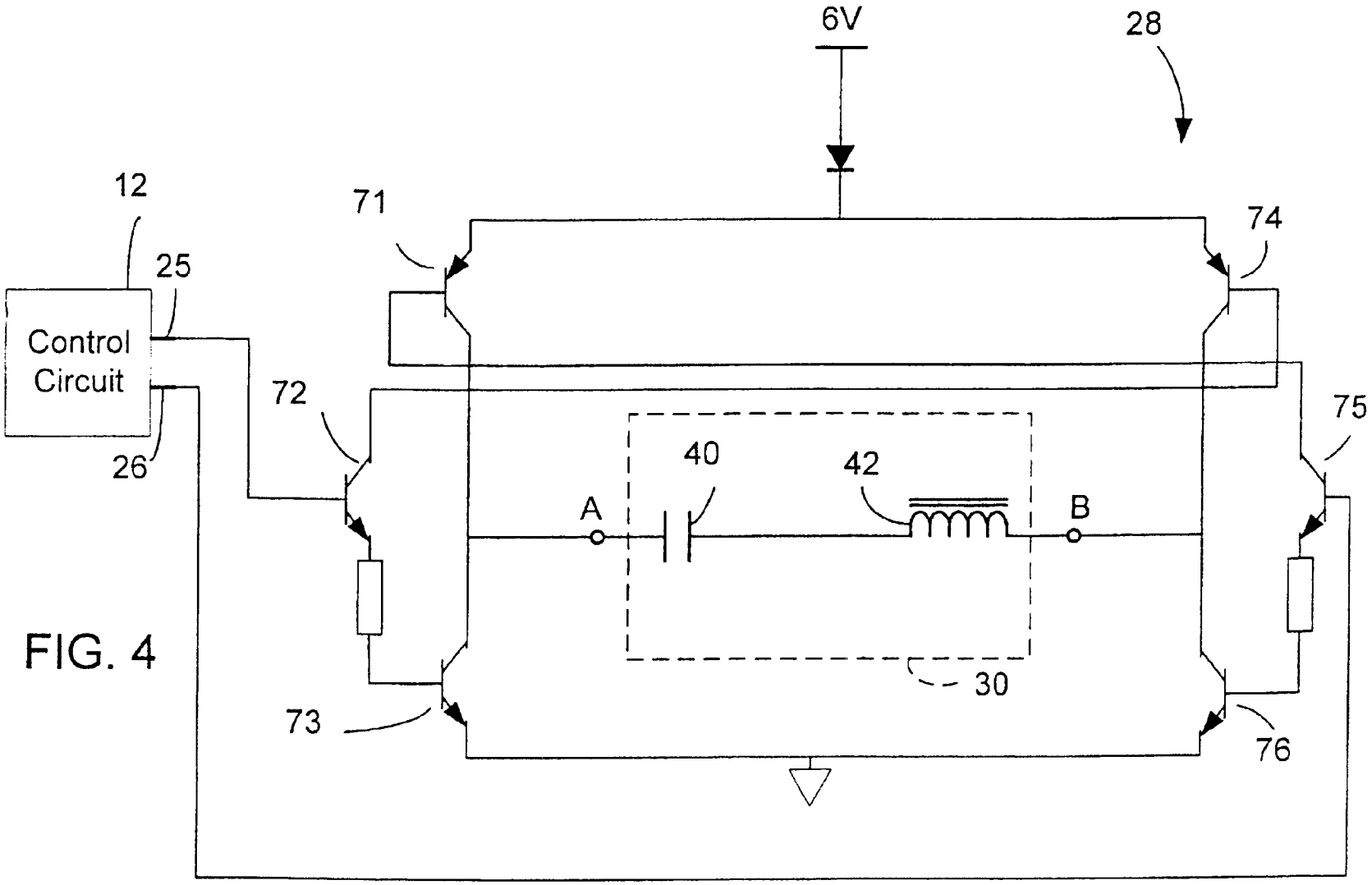
FIG. 4 is an embodiment of a locking system incorporating the actuating circuit of FIG. 2 for energizing the access-control solenoid.

An embodiment of the electronic locking system incorporating the RLC circuit of FIG. 2 is shown in FIG. 4. In this embodiment, the drive circuit 28 (FIG. 1) comprises transistors 71–76. These transistors, together with the capacitor 40 and solenoid 42, form an "H" bridge, with the serially connected capacitor and solenoid positioned across the two legs of the "H" bridge. The operation of the H bridge is controlled by two pins 25 and 26 of the control circuit 12. When both pins are at a "0" state, there is no voltage difference between points A and B at the two ends of the serially connected capacitor 40 and solenoid 42, and the actuating circuit is in an inactive state. To operate the H bridge, each of the pins 25 and 26 is alternated between the "1" and "0" states, and the two pins are kept in opposite states. In this way, an AC control signal is generated between the two pins 25 and 26. In response to this AC control signal, an AC drive signal is generated between points A and B of the H bridge.

By way of example, in one exemplary implementation, the solenoid has an inductance of 105 milli-henries, and a resistance of 9 ohms. The capacitor is chosen to have a capacitance of 470 microfarads. The calculated resonance frequency of this RLC circuit is 22.7 Hz. When a modulated drive signal at this resonance frequency is applied, the capacitive impedance and inductive impedance will cancel each other out, and the plunger might be expected to oscillate between the extended and retracted positions. It has been observed, however, that the movement of the plunger with a drive signal frequency about or slight above the calculated resonance frequency is primarily to the retracted position, and thereafter with slight oscillations of a small amplitude, such as 0.03 inch, in and out the fully retracted position. Although a theoretical explanation is not critical to the invention, it has been suggested that the retraction of the plunger is due to (1) the magnetic field in the solenoid never fully collapses while the AC drive signal is applied, and (2) the power required to hold the plunger in the retracted position is very small, and the force required for the bias spring to overcome the plunger mass, momentum, and the residual magnetism to move the plunger back to the extended position is relatively large.

The usable frequency range of the Modulated drive signal for the example given above is relatively narrow, from about 20 Hz to about 31 Hz. With the control signal frequency below 20 Hz, the plunger experiences difficulty going to the retracted position, likely due to the larger impedance of the capacitor. With the control signal frequency above 31 Hz, the increased inductive impedance of the solenoid prevents the solenoid coil from building a sufficient magnetic field to keep the plunger retracted. Preferably the frequency of the AC drive signal is set to be slightly higher than the resonance frequency of the RLC circuit. This is because it has been observed that such a drive frequency results in less vibration of the plunger in the retracted position.

Figure 5:
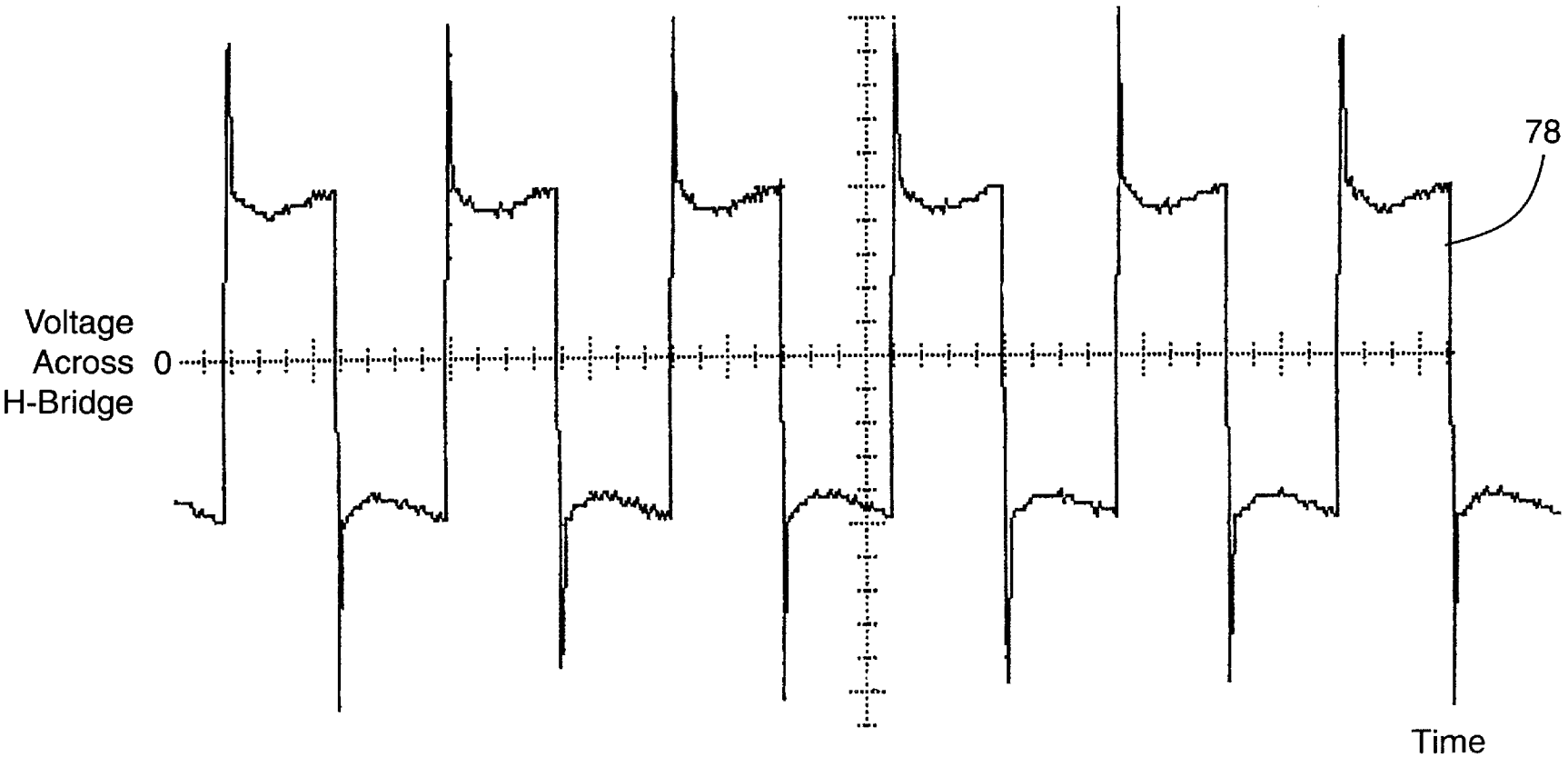
FIG. 5 is a chart showing the waveform of an AC drive signal generated in an implementation of the embodiment of FIG. 4 to energize an access-control solenoid.
Figure 6:
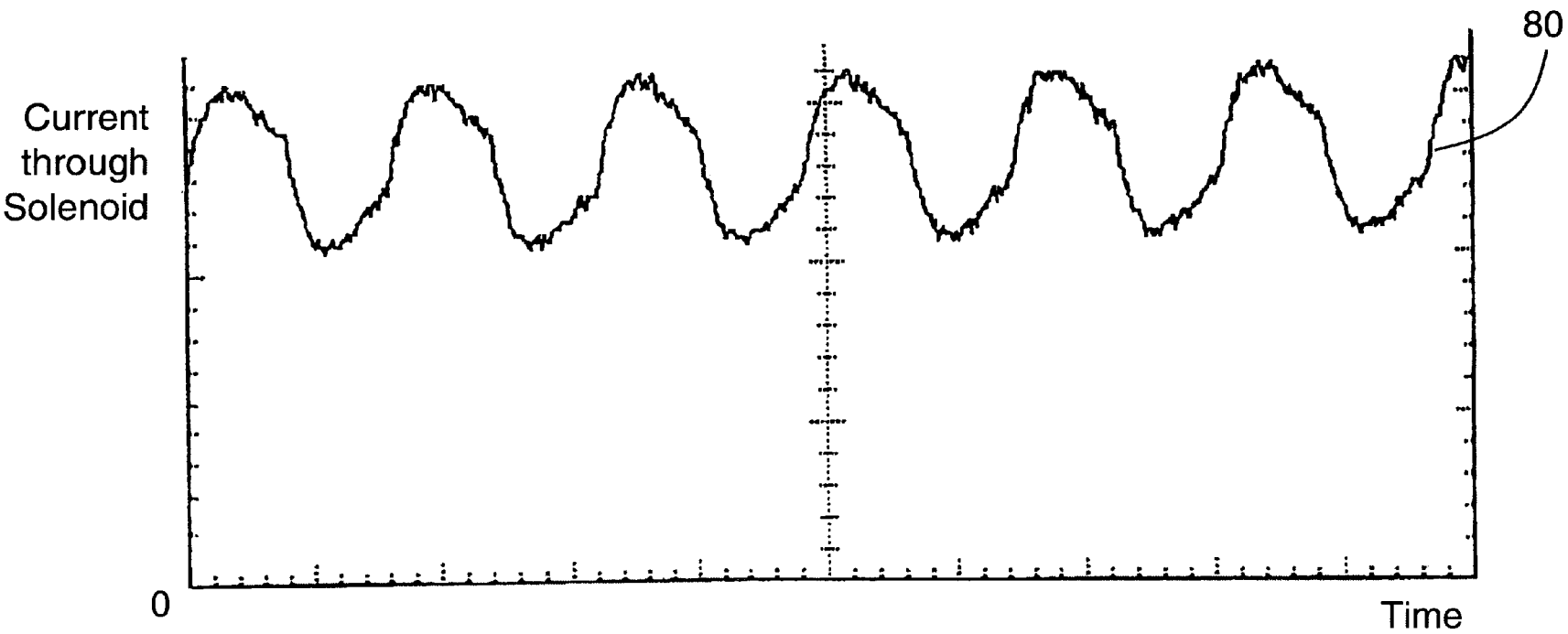
FIG. 6 is a chart showing a current flowing through an access-control solenoid in an implementation of the embodiment of FIG. 4 in response to the AC drive signal of FIG. 5.

FIG. 5 shows an exemplary plot of an AC drive signal measured for another implementation of the locking system of FIG. 4. In that implementation, the resonance frequency of the RLC circuit formed by the solenoid and capacitor is about 29 Hz. The operation frequency of the drive signal 78 in FIG. 4 is set at about 31.2 Hz. The current flowing through the solenoid caused by the AC drive signal in FIG. 5 is shown in FIG. 6. As can be seen, the current 80 through the solenoid has a significant DC component, which is sufficient to withdraw the plunger and hold it in the retracted position. Although the AC component of the current 80 causes the plunger to vibrate in that position, the magnitude of the vibration is sufficiently small so as not to interfere with the unlocking of the locking mechanism.

In accordance with a feature of the embodiment, improved energy efficiency in operating the solenoid is achieved by using different frequencies of the AC drive signal for retracting the plunger and for retaining the plunger in its retracted position. It has been observed that after the plunger has moved into its retracted position less energy or current is required to effectively maintain it in that position. Increasing the control signal frequency further from the resonance frequency results in less current flow through the capacitor and solenoid coil, with correspondingly reduced consumption of the battery power. Thus, it is advantageous to control the solenoid by first supplying an AC drive signal adjacent the resonant frequency to move the plunger to its retracted position, and then change the AC drive signal to a higher frequency further away from the resonant frequency to hold the plunger in the retracted position until the locking mechanism is operated. For example, in the above described implementation with the resonant frequency at 22.7 Hz, the AC drive signal may be set at 29 Hz for one second to move the plunger to its retracted position, and then changed to 45 Hz for four (4) seconds to hold the plunger in the retracted position to allow the user to unlock the locking mechanism.

Figure 7:
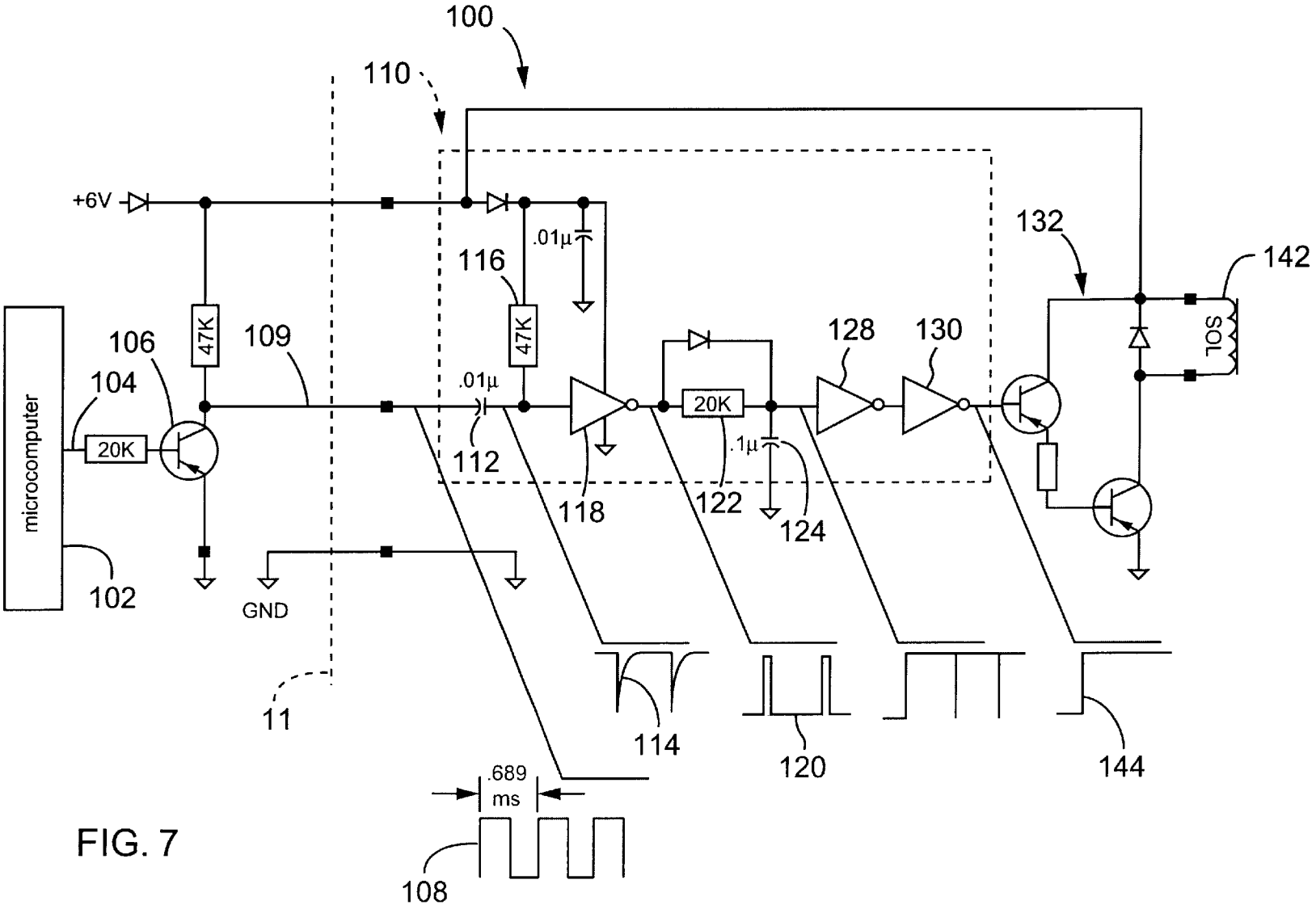
FIG. 7 is a schematic diagram of an actuating circuit of an alternative embodiment of the invention and illustrating waveforms of signals at different stages of the actuating circuit.

FIG. 7 shows an alternative embodiment of the locking system that utilizes a different actuating circuit 100 for energizing an access-control solenoid in response to a modulated drive signal. In contrast to the embodiment of FIG. 4, which uses a decoupling capacitor in series with the solenoid, the actuating circuit 100 contains an AC-coupled monostable (ACM) circuit 110. This ACM circuit 110 is preferably mounted inside the secured enclosure 11 for protection from tampering. To energize the solenoid to retract its plunger, the microprocessor 102 switches the output of a pin 104 between 0 and 1 to form a voltage-modulated control signal at a frequency set according to the characteristics of the ACM circuit 110 as will be described in greater detail below. The output of the microprocessor pin 104 is used to control a transistor 106 to generate a voltage-modulated drive signal 108, which is coupled through a wire 109 to the ACM circuit 110 inside the secured enclosure.

The ACM circuit 110 performs two functions with respect to the voltage-modulated control signal 108. First, the capacitor 112, which in the illustrated embodiment has a capacitance of 0.01 microfarad, will block any DC voltage connected to the external end of the signal wire 109. Thus, any attempt to "hot-wire" the circuit by connecting a DC voltage to the wire 109 will fail to cause current to flow through the solenoid to retract the plunger.

Second, the ACM circuit 110 serves as a pulse-width modifier that modifies the pulse width of the incoming voltage-modulated drive signal 108 to a constant pulse width regardless of the frequency of the drive signal. The ACM circuit 110 is triggered off the falling edges of the control signal 108 that passes through the capacitor 112. More particularly, the waveform 114 of the voltage after the capacitor 112 includes a series of narrow pulses corresponding to the falling edges of the input drive signal 108. Each pulse in the waveform 114 has an RC decay determined by the values of the capacitor 112 and the resistor 116. The pulses in the waveform 114 form the input to an inverter 118, which in response generates a waveform 120 containing narrow square wave pulses. These pulses then enter a time-delay circuit formed by a resistor 122 and a capacitor 124. The time-delay circuit and two downstream inverters 128 and 130 form another monostable stage, and the pulse-width of the output of the inverter 130 is determined by the RC discharge rate of the time-delay circuit. In the illustrated embodiment, the resistor 122 has a resistance of 12K ohms, and the capacitor 124 has a capacitance of 0.1 microfarad. These values give the output of the inverter 130 a pulse-width of approximately 1.38 milliseconds. Thus, the ACM circuit 110 will attempt to convert the AC coupled drive signal back to a voltage-modulated signal with a pulse-width of 1.38 milliseconds regardless of the frequency of the drive signal. The output of the inverter 130 is then used to drive an output stage 132, the output of which is then applied to the solenoid for energizing thereof.

The frequency of the voltage-modulated drive signal as generated by the microprocessor 102 is set according to the output pulse width of the ACM circuit 110. Generally, to retract the plunger of the solenoid 142, the frequency of the control signal is preferably chosen such that the period of the drive signal is shorter than the output pulse width of the ACM circuit 110. For example, in the embodiment of FIG. 7, the drive signal 108 may be set to have a frequency of 1450 Hz, which corresponds to a period of 0.689 millisecond. As described above, for each pulse in the drive signal, the ACM circuit 110 attempts to generate an output pulse with a pulse width of 1.38 milliseconds. Since the output pulse width of the ACM circuit 110 is longer than the period of the drive signal, the output of the ACM circuit becomes a DC voltage, as illustrated by the waveform 144. This causes the output stage 132 to operate in a "full-on" state to apply a current through the solenoid 142 to retract its plunger.

Figure 8:
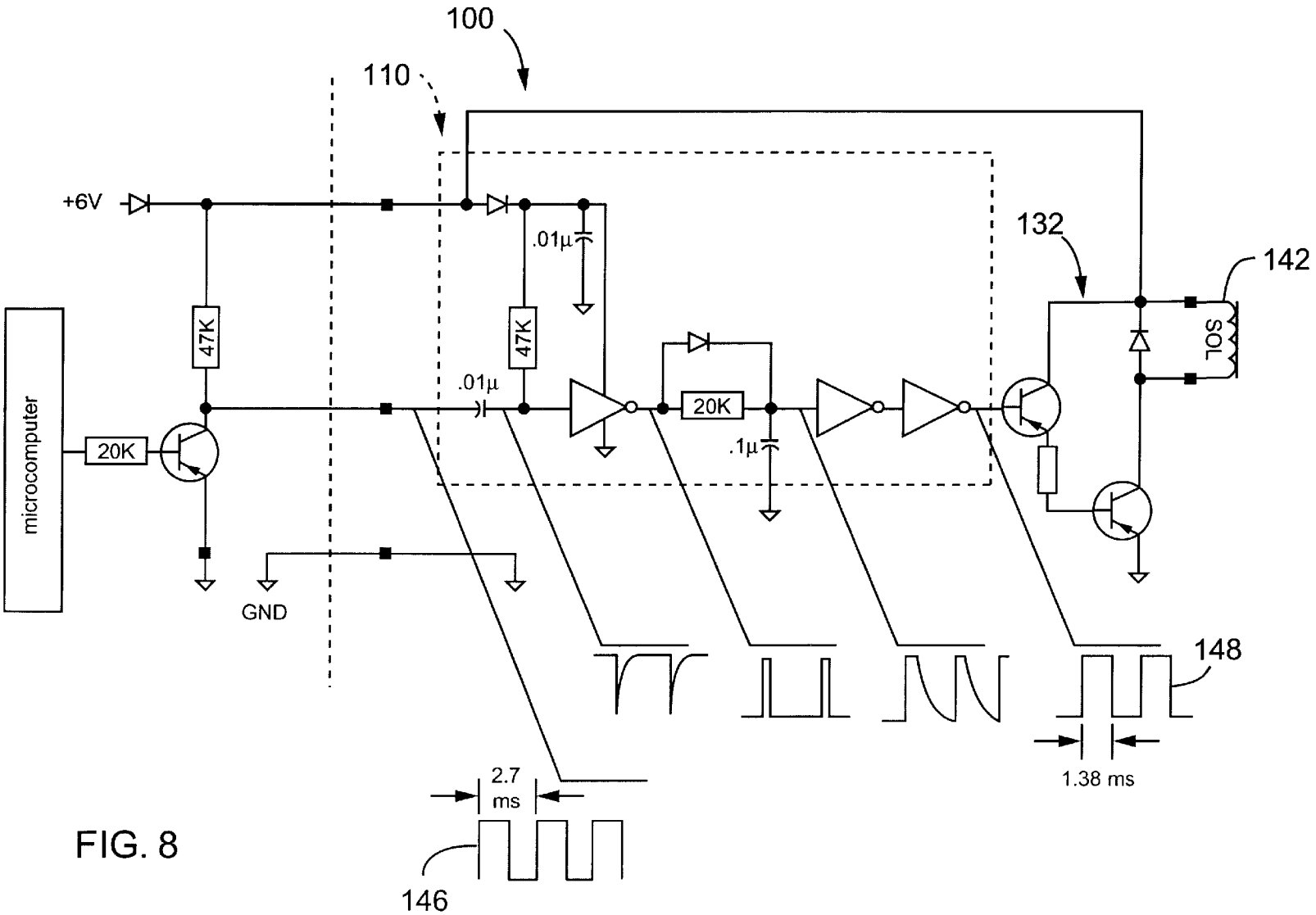
FIG. 8 is a schematic diagram similar to FIG. 7 but with waveforms of signals at a frequency different from that of FIG. 7.

In accordance with a feature of the embodiment, a reduced energy consumption is achieved by using a reduced drive signal frequency to operate the actuating circuit 100 once the plunger of the solenoid 142 is moved into its retracted position. By way of example, in the embodiment of FIG. 7, after the plunger of the solenoid 142 is retracted, the frequency of the drive signal may be reduced to 360 Hz for retaining the plunger in the retracted position. Referring now to FIG. 8, the period of the drive signal 146 at this frequency is about 2.7 milliseconds, which is longer than the output pulse width of the ACM circuit 110. As a result, the output waveform 148 of the ACM circuit contains a series of square pulses with a frequency of 360 Hz and a pulse width of 1.38 milliseconds. As a result, the transistors of the output stage 132 are operated at about 44% duty cycle, and about 44% of the full-on current will flow through the solenoid 142. The drive signal frequency is selected such that the resultant average current through the solenoid is adequate to hold the plunger in the retracted position.

In view of the foregoing detailed description, it can be appreciated that the present invention provides a system and method for operating an access-control solenoid in an electronic locking system such that the locking system is substantially immune to tampering by hot-wiring. The embodiments of the invention is very easy and cost effective to implement, while providing significantly improve immunity to tampering by the commonly used hot-wiring method.

What is claimed is:

1. An electronic locking system for controlling operation of a locking mechanism, comprising:

a solenoid having a plunger coupled to the locking mechanism for retaining the locking mechanism in a locked condition when the plunger is in an extended position, the solenoid energizable to move the plunger to an retracted position to allow the locking mechanism to be unlocked;

a control circuit for generating a modulated drive signal;

an actuating circuit receiving the modulated drive signal through a wire and coupled to the solenoid for energizing thereof, the actuating circuit preventing a DC voltage applied to said wire from reaching the solenoid, the modulated drive signal having a first frequency selected to cause the actuating circuit to apply a current through the solenoid to retract the plunger in response to the modulated drive signal.

2. An electronic locking system as in claim 1, wherein the actuating circuit includes a capacitor connected in series with the solenoid.

3. An electronic locking system as in claim 2, wherein the capacitor and the solenoid form an RLC circuit having a resonance frequency, and wherein the first frequency of the modulated drive signal is adjacent the resonance frequency.

4. An electronic locking system as in claim 3, wherein the first frequency of the modulated drive signal is adjacent and above the resonance frequency.

5. An electronic locking system as in claim 2, wherein the actuating circuit includes a pulse-width modifier for generating pulses of a constant pulse-width in response to the modulated drive signal.

6. An electronic locking system as in claim 5, wherein the modulated drive signal at the first frequency has a period shorer than the constant pulse-width of the pulse-width modifier.

7. An electronic locking system as in claim 6, wherein the control circuit generates the modulated drive signal at a second frequency lower than the first frequency for retaining the plunger in the retracted position.

8. An electronic locking system as in claim 1, further including an input device for entering an access code and wherein the control circuit verifies the access code from the input device and generates the modulated drive signal when the access code is verified.

9. An electronic locking system as in claim 8, wherein the input device is a keypad.

10. An electronic locking system as in claim 1, wherein the control circuit includes a microprocessor.

11. An electronic locking system as in claim 10, further comprising a battery for powering the control circuit and the actuating circuit, and a low-battery detection circuit connected to the control circuit for detecting a low-battery condition of the battery.

12. A method of operating an electronic locking system having a solenoid with a plunger for controlling operation of a locking mechanism, comprising the steps of:

entering an access code through an input device;

verifying the access code;

upon verification of the access code, applying an AC drive signal to the solenoid through a capacitor, the solenoid and the capacitor forming an RLC circuit having a resonance frequency, the AC drive signal having an first frequency adjacent the resonance frequency for energizing the solenoid to move the plunger of the solenoid into a retracted position.

13. A method as in claim 12, further including the step of changing the AC drive signal to a second frequency higher than the first frequency to retain the plunger in the retracted position.

14. A method of operating an electronic locking system having a solenoid for controlling operation of a locking mechanism, comprising the steps of:

entering an access code through an input device;

verifying the access code;

upon verification of the access code, generating a voltage-modulated drive signal;

applying the voltage-modulated drive signal of a first frequency to a monostable circuit to generate an output signal having a constant pulse-width in response to the voltage-modulated drive signal;

controlling current flow through the solenoid in response ti the output signal to energize the solenoid to move the plunger of the solenoid into a retracted position.

15. A method as in claim 14, wherein the voltage modulated drive signal at the at the first frequency has a period shorter than the constant pulse-width of the monostable circuit.

16. A method as in claim 14, further including the step of changing the voltage-modulated drive signal to a second frequency to have a period greater than the constant pulse-width of the monostable circuit for retaining the plunger in the retracted position.

* * * * *